US010672326B2

(12) United States Patent
Cheng

(10) Patent No.: US 10,672,326 B2
(45) Date of Patent: Jun. 2, 2020

(54) PIXEL DRIVING CIRCUIT

(71) Applicant: AU OPTRONICS CORPORATION, Hsin-Chu (TW)

(72) Inventor: Mao-Hsun Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/227,586

(22) Filed: Dec. 20, 2018

(65) Prior Publication Data

US 2019/0251896 A1 Aug. 15, 2019

(30) Foreign Application Priority Data

Feb. 14, 2018 (TW) ..... 107105664 A

(51) Int. Cl.
*G09G 3/32* (2016.01)

(52) U.S. Cl.
CPC ..... *G09G 3/32* (2013.01); *G09G 2300/0819* (2013.01); *G09G 2320/0233* (2013.01); *G09G 2320/045* (2013.01)

(58) Field of Classification Search
CPC ..... G09G 3/32; G09G 2300/0819; G09G 2320/0233; G09G 2320/045
See application file for complete search history.

(56) References Cited

U.S. PATENT DOCUMENTS 5,629,614 A * 5/1997 Choe ..... H03F 3/345 323/315
7,023,408 B2 4/2006 Chen et al.
9,343,014 B2 5/2016 Huang et al.
9,842,539 B2 12/2017 Hung et al.
9,892,688 B2 2/2018 In et al.
2013/0088165 A1 4/2013 Wang et al.
2016/0125808 A1 5/2016 Hsu et al.
2017/0278457 A1* 9/2017 Zhu ..... G09G 3/3233
2018/0061312 A1* 3/2018 He ..... G09G 3/325
2018/0268760 A1* 9/2018 Chen ..... G09G 3/3233
2018/0315374 A1* 11/2018 Zhang ..... G09G 3/3208
2019/0180688 A1* 6/2019 Yang ..... G09G 3/3233

FOREIGN PATENT DOCUMENTS

CN 104978926 A 10/2015
CN 105788526 A 7/2016
CN 106128362 A 11/2016
JP 2011158821 8/2011
TW I533278 5/2016

OTHER PUBLICATIONS

An office action from the CNIPA dated on Jul. 29, 2019.

* cited by examiner

*Primary Examiner* — Towfiq Elahi
(74) *Attorney, Agent, or Firm* — WPAT, PC

(57) ABSTRACT

A pixel driving circuit includes a first transistor receiving a data signalsame. A first end of a second transistor is connected to the first end of the first transistor, and a gate of the same is connected to a second end of the second transistor. A second end of a third transistor is connected to the second end of the second transistor. A first end of a fourth transistor is connected to the gate of the first transistor. A second end of a fifth transistor is connected to the first end of the first transistor. A first end of the sixth transistor is connected to a second end of the first transistor. An anode of a light emitting diode is connected to a second end of the sixth transistor. A capacitor is connected between the first end and the gate of the first transistor.

10 Claims, 8 Drawing Sheets

PIXEL DRIVING CIRCUIT

BACKGROUND OF THE INVENTION

1. Field of the Invention

The present invention relates to a pixel driving circuit, and specifically, to a pixel driving circuit including a light emitting diode display device.

2. Description of the Prior Art

Generally, a light emitting diode display device includes a data circuit, a scanning circuit, and a pixel driving circuit. The pixel driving circuit drives a light emitting diode to emit light according to a data signal provided by the data circuit and a scan signal provided by the scanning circuit. Generally, a driving current of the light emitting diode is related to the data signal and a threshold voltage of a transistor in the pixel driving circuit. However, the foregoing threshold voltage often deviates because of a process factor, and therefore, affects actual brightness of the light emitting diode.

To resolve the foregoing problem, for an existing organic light emitting diode display device, an improved design of a pixel driving circuit is probably provided to eliminate an impact of the threshold voltage. However, the existing improved design usually requires a plurality of control signals. Therefore, a relatively large circuit layout area is required, and a circuit structure of a panel border is relatively complex. In addition, in the existing improved design, during a circuit operation, there may be a direct-current quiescent current path, resulting in extra power consumption. Therefore, the circuit structure of the existing organic light emitting diode display device still needs to be improved.

SUMMARY OF THE INVENTION

A pixel driving circuit includes a first transistor receiving a data signal via a first end or a gate. A first end of a second transistor is connected to the first end of the first transistor, and a gate of the same is connected to a second end of the second transistor. A second end of a third transistor is connected to the second end of the second transistor, and a gate of the same receives a first scan signal. A first end of a fourth transistor is connected to the gate of the first transistor, and a gate of the same receives the first scan signal. A second end of a fifth transistor is connected to the first end of the first transistor, and a gate of the same receives a second scan signal. A first end of a sixth transistor is connected to a second end of the first transistor, and a gate of the same receives the second scan signal. An anode of a light emitting diode is connected to a second end of the sixth transistor. A capacitor is connected between the first end and the gate of the first transistor.

An objective of the present invention is to provide a pixel driving circuit, capable of providing a stable driving current.

An objective of the present invention is to provide a pixel driving circuit, capable of narrowing a peripheral area of a display panel and reducing power consumption.

DETAILED DESCRIPTION OF THE PREFERRED EMBODIMENT

The spirit of the present disclosure is clearly described below by using drawings and detailed descriptions. After understanding embodiments of the present disclosure, any person of ordinary skill in the art can make variations and modifications according to the technology taught by the present disclosure without departing from the spirit and scope of the present disclosure.

The terms "first", "second", and the like used in the present disclosure do not specifically mean an order or a sequence, and are not used to limit the present invention, but are merely used to distinguish elements or operations that are described by using the same technical terms.

"Electrical coupling" used in this specification may refer to that two or more elements are in direct physical or electrical contact, or are in indirect physical or electrical contact, while "electrical coupling" may also refer to that two or more elements are interoperable or interacting.

The terms "comprise", "include", "have", "contain", and the like used in the present disclosure are all open-ended terms, and mean "include, but not limited to".

The wording "and/or" used in the present disclosure includes any or all combinations of the items.

The terms used in the present disclosure, unless specifically indicated, usually each have a common meaning of the terms used in the art, in the present disclosure, and in the special content. Some terms used to describe the present disclosure are discussed below or somewhere else in this specification, so as to provide additional guidance in the description of the present disclosure to a person skilled in the art.

Embodiments are specifically provided below for detailed description according to the pixel driving circuit of the present invention with reference to the accompanying drawings, but the provided embodiments are not used to limit the scope of by the present invention.

Figure 1:
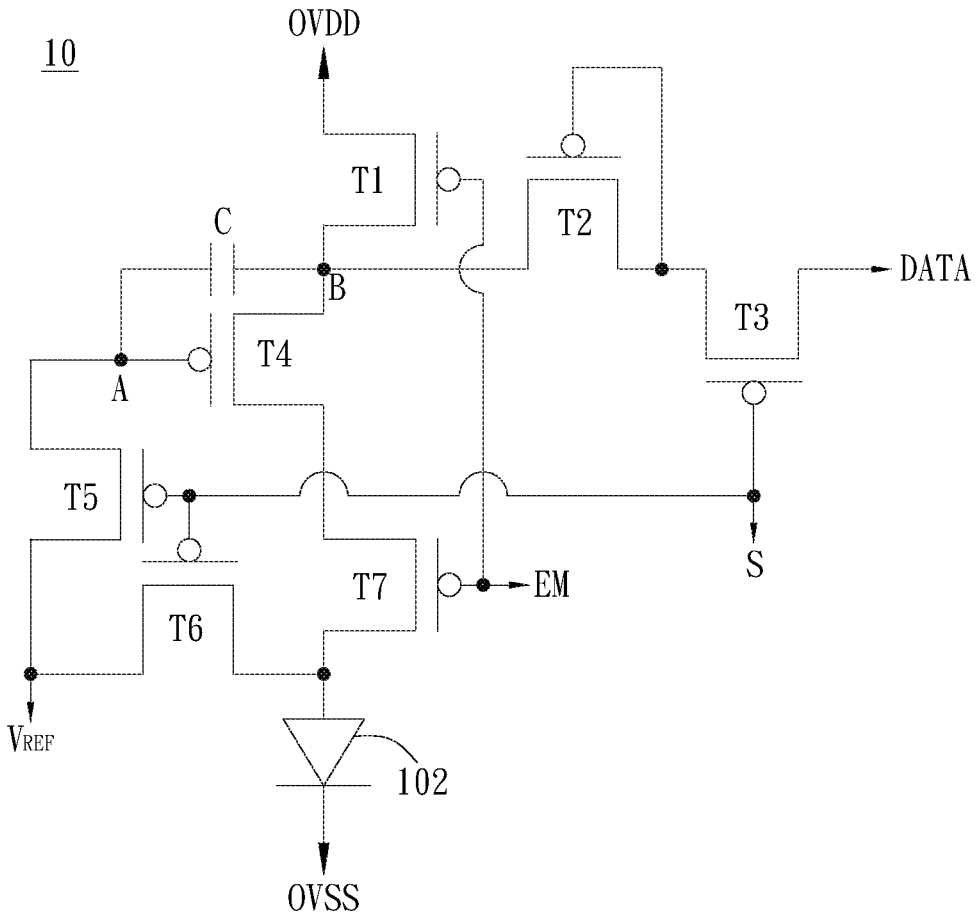
FIG. 1 is a schematic diagram of an embodiment of a pixel driving circuit according to the present invention.

The present invention provides a pixel driving circuit, applicable to, for example, an organic light emitting diode display. Referring to FIG. 1, FIG. 1 is a schematic diagram of an embodiment of a pixel driving circuit according to the present invention. As shown in FIG. 1, a pixel driving circuit 10 may include transistors T1 to T5, a transistor T7, a capacitor (C), and a light emitting diode 102. The foregoing transistors T1 to T5 and T7, for example, are thin-film transistors, and each transistor includes a first end, a second end, and a gate. The transistor T4 receives a data signal via its first end. The first end of the transistor T2 is electrically connected to the first end of the transistor T4, and the gate of the same is connected to the second end of the transistor T2. The first end of the transistor T3 receives a first voltage signal, and the second end of the same is connected to the second end of the transistor T2. The gate of a transistor T3 receives a scan signal (S), and turns on the transistor T3 according to the scan signal (S). In this embodiment, the first voltage signal is a data signal DATA, a second voltage signal is a reference signal $V_{REF}$, and a voltage level of the data signal DATA is greater than a voltage level of the reference signal $V_{REF}$. The first end of the transistor T5 is electrically connected to the gate of the transistor T4, and the second end of the same receives the second voltage signal ($V_{REF}$). The gate of the transistor T5 receives the scan signal (S), and turns on the transistor T5 according to the scan signal (S). The first end of the transistor T1 receives a supply voltage OVDD, and the second end of the same is electrically connected to the first end of the transistor T4. The gate of the transistor T1 receives another scan signal EM. The first end of the transistor T7 is electrically connected to the second end of the transistor T4, and the gate of the transistor T7 receives the scan signal EM. The light emitting diode 102 includes an anode and a cathode. The anode is electrically connected to the second end of the transistor T7, and the cathode receives another supply voltage OVSS. The capacitor (C) is electrically connected between the first end and the gate of the transistor T4.

Figure 2:
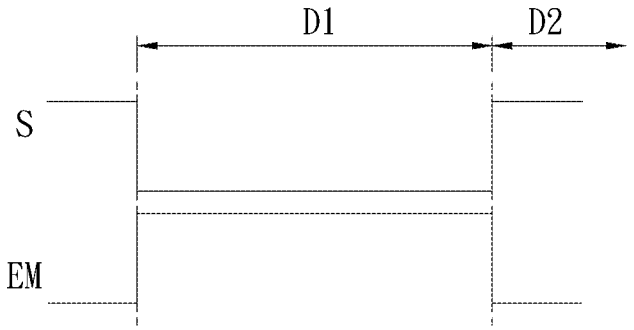
FIG. 2 is a schematic diagram of a signal of the pixel driving circuit.
Figure 3A:
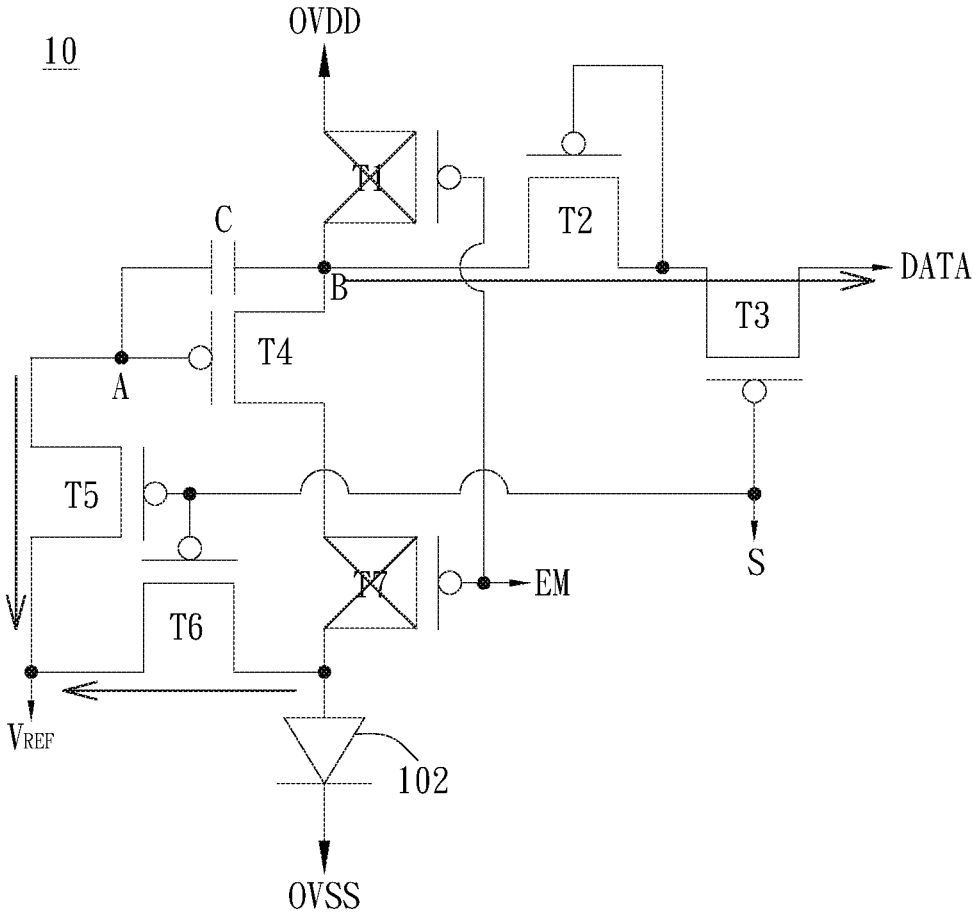
FIG. 3A and FIG. 3B are schematic diagrams of the pixel driving circuit shown in FIG. 2 in different operation modes.
Figure 3B:
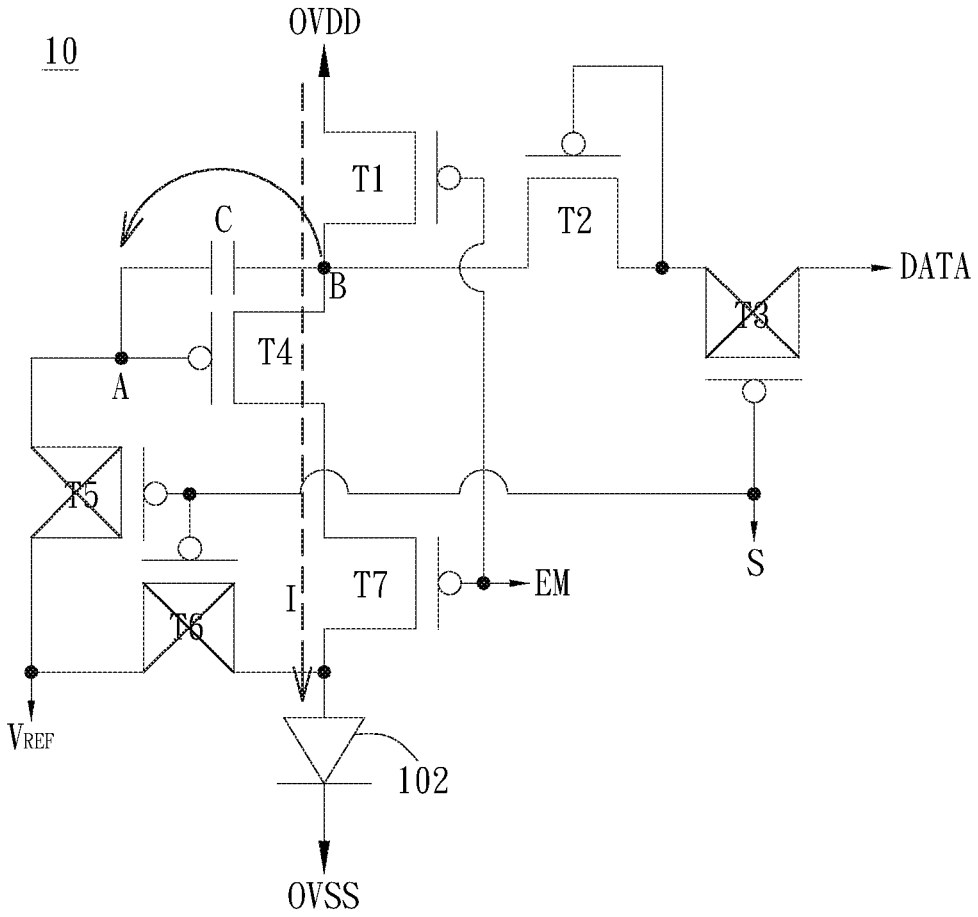

For operations on the pixel driving circuit 10, refer to FIG. 2, FIG. 3A, and FIG. 3B. FIG. 2 is a schematic diagram of a signal of the pixel driving circuit 10. FIG. 3A and FIG. 3B are schematic diagrams of the pixel driving circuit 10 shown in FIG. 2 in different operation modes. As shown in FIG. 2, in duration D1, the scan signal (S) is changed from a high voltage level to a low voltage level, and the scan signal EM is changed from the low voltage level to the high voltage level. As shown in FIG. 3A, in this case, the transistor T1 and the transistor T7 are in an off state, and the transistor T3 and the transistor T5 are in an on state. The gate (the point A) of the transistor T4 is discharged to $V_{REF}$. The first end (the point B) of the transistor T4 has a high level of the supply voltage OVDD in a previous stage, and is discharged to a sum of the data signal DATA and an absolute value $V_{th_T2}$ of a threshold voltage of the transistor T2 (that is, DATA+$|V_{th_T2}|$) in the duration D1.

Subsequently, as shown in FIG. 2, in duration D2, the scan signal (S) is changed from the low voltage level to the high voltage level, and the scan signal EM is changed from the high voltage level to the low voltage level. As shown in FIG. 3B, in this case, the transistor T3 and the transistor T5 are in the off state, and the transistor T1 and the transistor T7 are in the on state. The gate (the point A) of the transistor T4 changes into a floating state, the first end (the point B) of the transistor T4 is charged to a voltage value of the supply voltage OVDD, so that a variation of voltage at the point (B) is directly reflected at the point (A). The light emitting diode 102 emits light according to a driving current (I) flowing through the transistors T1, T4, and T7.

For example, the variation of voltage at the point (B) is, for example, (OVDD−DATA−$|V_{th_T2}|$), so that in the duration D2, the point (A) has ($V_{REF}$+OVDD−DATA−$|V_{th_T2}|$). In this case, the voltage level of the first end (the point B) of the transistor T1 is OVDD, and the voltage level of the gate (the point A) is $V_{REF}$+OVDD−DATA−$|V_{th_T2}|$. The capacitor (C) maintains the voltage difference between the point (B) and the point (A) in the duration D2. Therefore, the driving current satisfies: $I=(1/2)k(DATA-V_{REF})^2$. It should be understood that the driving current is usually related to the supply voltage and the threshold voltage value of a driving transistor. By means of a design of the foregoing embodiment, impacts of the supply voltage and the threshold voltage value of the driving transistor are eliminated from the driving current. In this way, it can be ensured that the driving current is prevented from being affected by a process deviation or a supply voltage change, so as to provide a stable driving current, and improve display quality.

In the embodiments shown in FIG. 1, FIG. 3A, and FIG. 3B, the transistor T2 and the transistor T4 are transistors of the same type, and preferably, have the same threshold voltage value (that is, $V_{th_T2}=V_{th_T4}$), so that driving transistors in the same pixel can have an even threshold voltage value, so as to provide operation stability in the duration D1 and D2. Further, when the transistor T1 to T5 and T7 are transistors of the same type (for example, P-type transistors), waveforms of the scan signal (S) and the scan signal EM are substantially in anti-phase, and the two signals become complementary signals. Compared with the prior art, the quantity of scan signals is reduced, so that the circuit design can be simplified to reduce the circuit layout area.

In addition, in an embodiment, the pixel driving circuit further includes a transistor T6. The transistor T6 may be, for example, a thin-film transistor, and includes a first end, a second end, and a gate. As shown in FIG. 3A, the first end of the transistor T6 is electrically connected to the second end of the transistor T5, and is configured to receive the second voltage signal ($V_{REF}$), and the second end of the same is electrically connected to the anode of the light emitting diode 102. The gate of the transistor T6 is configured to receive the scan signal (S). As shown in FIG. 2 and FIG. 3A, in the duration D1, the pixel driving circuit 10 turns on the transistor T6 according to the scan signal (S) and resets the anode of the light emitting diode 102. As shown in FIG. 3B, in the duration D2, the transistor T6 is in an off state. Hence, in the duration D1, the anode of the light emitting diode 102 is pulled to a low level ($V_{REF}$) to ensure that the light emitting diode 102 does not emit light in the duration D1. In an embodiment, the reference signal $V_{REF}$ is less than a sum of the supply voltage OVSS and an turn-on voltage of the light emitting diode 102, and a level of the reference signal $V_{REF}$ may be, for example, set to be equal to the supply voltage OVSS, but is not limited thereto.

Figure 4:
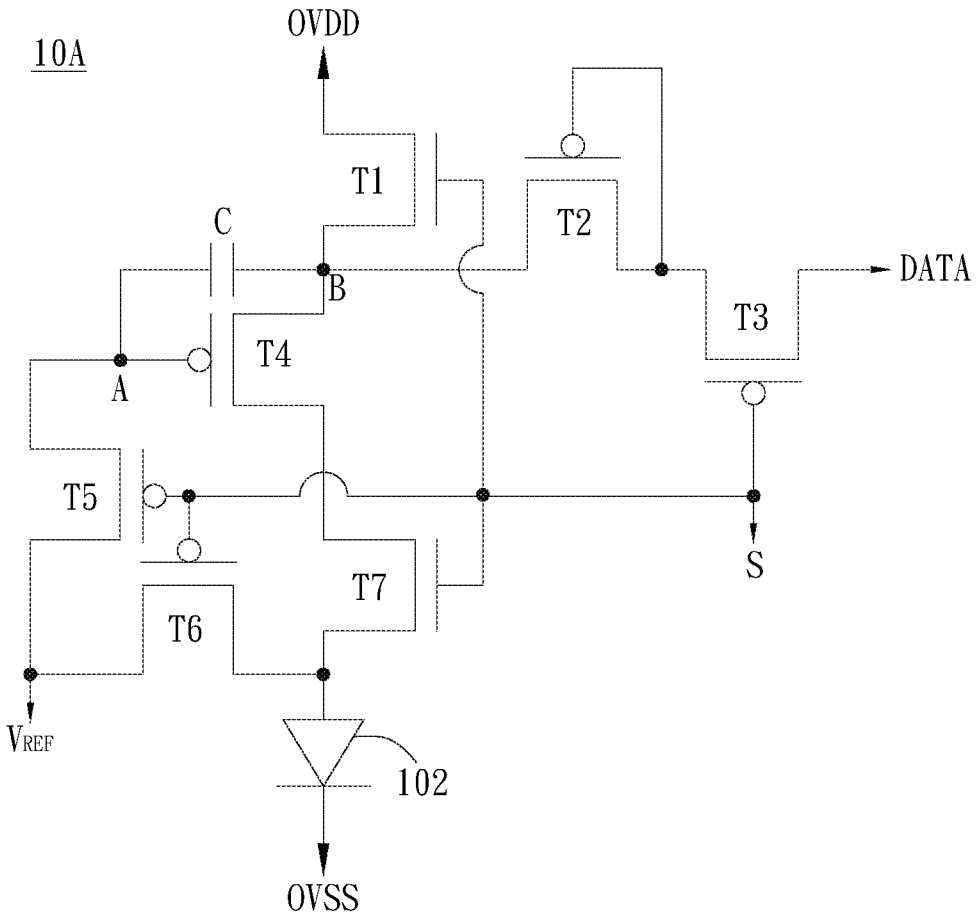
FIG. 4 and FIG. 5 are schematic diagrams of different embodiments of a pixel driving circuit having a single scan signal.
Figure 5:
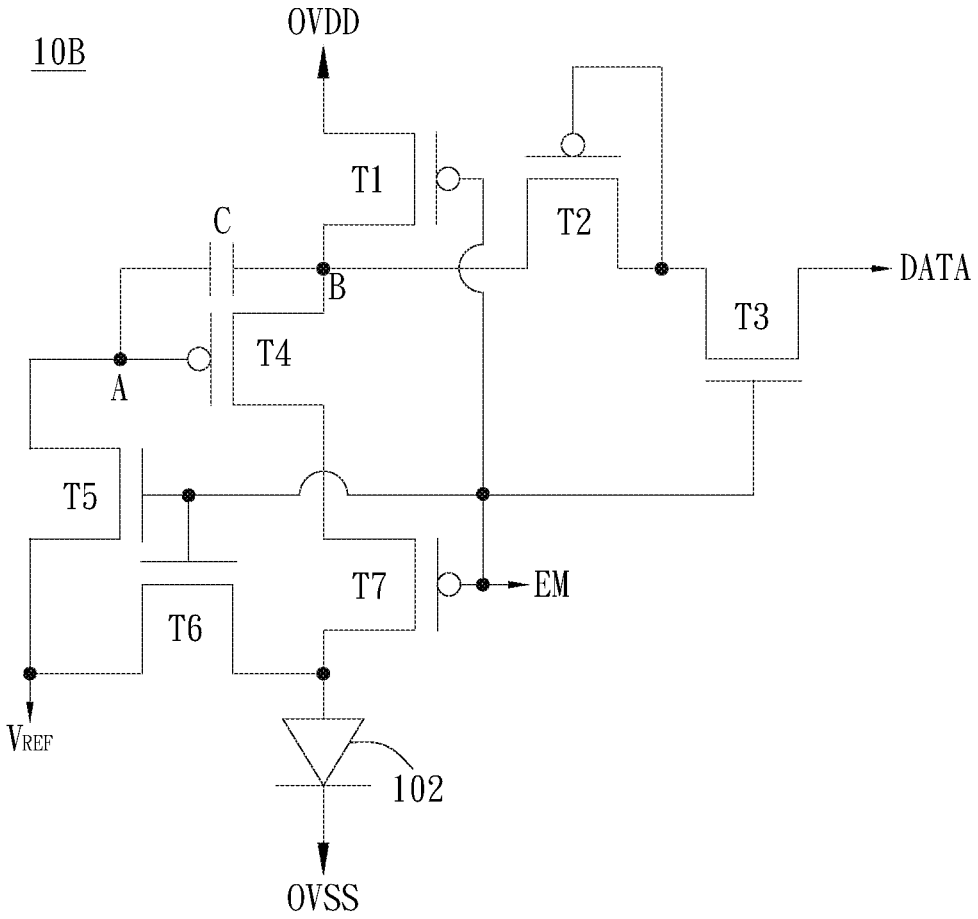

Referring to FIG. 4 and FIG. 5, FIG. 4 and FIG. 5 are schematic circuit diagrams of a pixel driving circuit 10A and a pixel driving circuit 10B according to another embodiment of the present invention. Connection relationships of elements of the transistors are substantially similar. It should be noted that this embodiment differs from the foregoing embodiment in that a pixel driving circuit 10A shown in FIG. 4 and a pixel driving circuit 10B shown in FIG. 5 have a single scan signal. First referring to FIG. 4, as shown in FIG. 4, the gates of the transistors T1, T3, T5, and T7 all receive the scan signal (S). In another embodiment, the gate of the transistor T6 also receives the scan signal (S). Specifically, the transistor T1 and the transistor T7 are transistors of the same type (for example, N-type transistors). When the transistor T3 and the transistor T5 are transistors of a same type different from the type to which the transistor T1 (for example, a P-type transistor) belongs, the scan signals are integrated into the same scan signal source. By means of further simplifying the circuit design, the circuit layout area is reduced. In another embodiment, the scan signal received by the gates of the transistors T1 and T7 can be independent of the scan signal received by the gates of the transistors T3 and T5, but output waveforms of the two scan signals are substantially in phase.

As shown in FIG. 5, in still another embodiment, the gates of the transistors T1, T3, T5, and T7 all receive the scan signal EM. In addition, the gate of the transistor T6 also receives the scan signal EM. Specifically, the transistor T1 and the transistor T7 are P-type transistors, the transistor T3 and the transistor T5 are N-type transistors, and the scan signals are integrated into the same scan signal source. By means of further simplifying the circuit design, the circuit layout area is reduced. In another embodiment, the scan signal received by the gates of the transistors T1 and T7 can be independent of the scan signal received by the gates of the transistors T3 and T5, but output waveforms of the two scan signals are substantially in phase. By means of the foregoing circuit design, the circuit layout area is reduced, and no direct-current quiescent current path is generated during an operation process, so that power consumption can be reduced.

Figure 6:
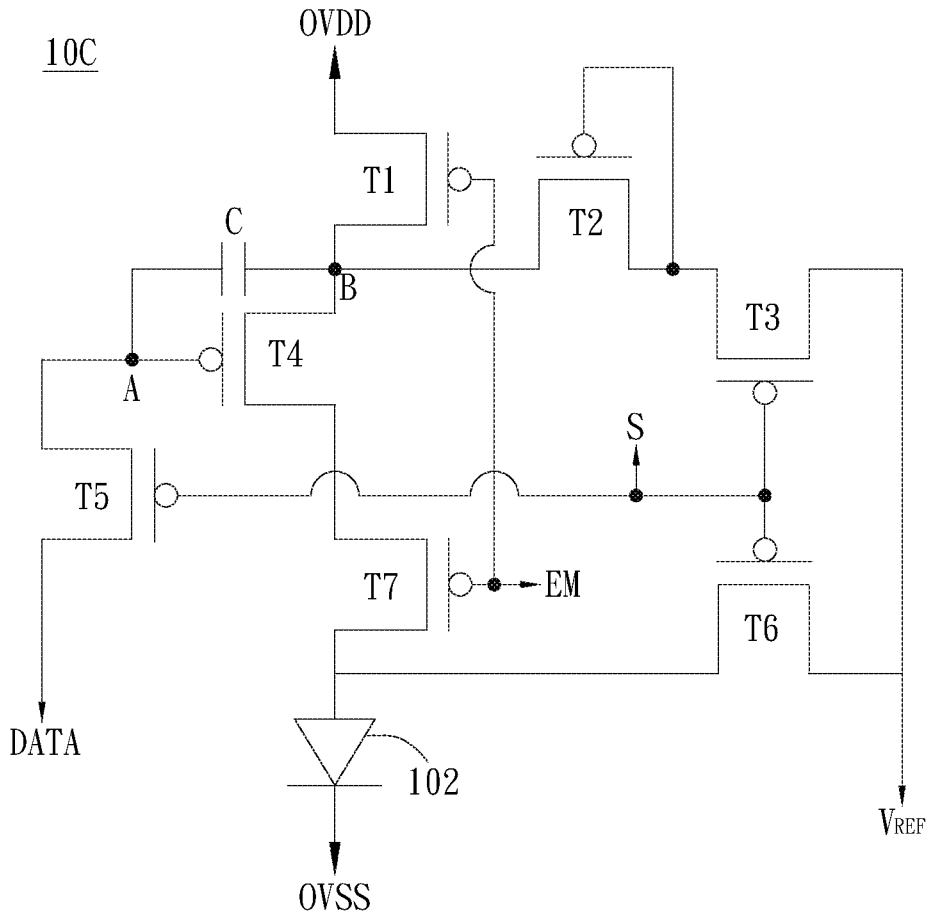
FIG. 6 is a schematic diagram of another embodiment of a pixel driving circuit.

FIG. 6 is a schematic diagram of another embodiment of a pixel driving circuit 10C. As shown in FIG. 6, a pixel driving circuit 10C includes transistors T1 to T5, the transistor T7, the capacitor (C), and the light emitting diode 102. The transistor T4 receives the data signal DATA via its gate. The first end of the transistor T2 is electrically connected to the first end of the transistor T4, and a gate of the same is connected to the second end of the transistor T2. The first end of the transistor T3 receives the first voltage signal, and the second end of the same is connected to the second end of the transistor T2. The gate of the transistor T3 receives a scan signal (S), and turns on the transistor T3 according to the scan signal (S). In this embodiment, the first voltage signal is the reference signal $V_{REF}$, the second voltage signal is the data signal DATA, and the voltage level of the data signal DATA is less than the voltage level of the reference signal $V_{REF}$. The first end of the transistor T5 is electrically connected to the gate of the transistor T4, and the second end of the same receives the second voltage signal (DATA). The gate of the transistor T5 receives the scan signal (S), and turns on the transistor T5 according to the scan signal (S). A first end of the transistor T1 receives the supply voltage OVDD, and the second end of the same is electrically connected to the first end of the transistor T4. The gate of the transistor T1 receives another scan signal EM. The first end of the transistor T7 is electrically connected to the second end of the transistor T4, and the gate of the transistor T7 receives the scan signal EM. The light emitting diode 102 includes the anode and the cathode. The anode is electrically connected to the second end of the transistor T7, and the cathode receives another supply voltage OVSS. The capacitor (C) is electrically connected between the first end and the gate of the transistor T4.

As stated above, the voltage level of the data signal DATA is less than the voltage level of the reference signal $V_{REF}$. For example, in this embodiment, the voltage level of the data signal DATA can be set to a negative value. Similarly, the signal operation shown in FIG. 2 is used. In duration D1, the scan signal (S) is changed from the high voltage level to the low voltage level, and the scan signal EM is changed from the low voltage level to the high voltage level. In the duration D1, the transistor T1 and the transistor T7 are in the off state, and the transistor T3 and the transistor T5 are in the on state. The gate (the point A) of the transistor T4 is discharged to the data signal DATA. The first end (the point B) of the transistor T4 has the high level of the supply voltage OVDD in a previous stage, and is discharged to a sum of the reference signal and an absolute value $V_{th_T2}$ of the threshold voltage of the transistor T2 (that is, $V_{REF}+|V_{th_T2}|$) in the duration D1.

Subsequently, in duration D2, the scan signal (S) is changed from the low voltage level to the high voltage level, and the scan signal EM is changed from the high voltage level to the low voltage level. In duration D2, the transistor T3 and the transistor T5 are in an off state, and the transistor T1 and the transistor T7 are in an on state. The gate (the point A) of the transistor T4 changes into the floating state, the first end (the point B) of the transistor T4 is charged to the voltage value of the supply voltage OVDD, so that the variation of voltage at the point (B) is directly reflected at the point (A). The light emitting diode 102 emits light according to the driving current flowing through the transistors T1, T4, and T7.

For example, the variation of voltage at the point (B) is, for example, $(OVDD-V_{REF}-|V_{th_T2}|)$, so that in the duration D2, the point (A) has $(DATA+OVDD-V_{REF}-|V_{th_T2}|)$. In this case, the voltage level of the first end (the point B) of the transistor T1 is OVDD, and the voltage level of the gate (the point A) is $DATA+OVDD-V_{REF}-|V_{th_T2}|$. The capacitor (C) maintains the voltage difference between the point (B) and the point (A) in the duration D2. Therefore, the driving current satisfies: $I=(1/2)k(V_{REF}-DATA)^2$. It should be understood that the driving current is usually related to the supply voltage and the threshold voltage value of the driving transistor. By means of the design of the foregoing embodiment, impacts of the supply voltage and the threshold voltage value of the driving transistor are eliminated from the driving current. In this way, it can be ensured that the driving current is prevented from being affected by the process deviation or the supply voltage change, so as to provide the stable driving current, and improve display quality.

In the embodiment shown in FIG. 6, the transistor T1 and the transistor T2 are transistors of the same type, and preferably, have the same threshold voltage value (that is, $V_{th_T2}=V_{th_T4}$), so that driving transistors in the same pixel can have an even threshold voltage value, so as to provide operation stability in the duration D1 and D2. Further, when the transistor T1 to T5 and T7 are transistors of the same type (for example, P-type transistors), waveforms of the scan signal (S) and the scan signal EM are substantially in anti-phase, and the two signals become complementary signals. Compared with the prior art, the quantity of scan signals is reduced, so that the circuit design can be simplified to reduce the circuit layout area.

In addition, in an embodiment, the pixel driving circuit further includes the transistor T6. The transistor T6 includes the first end, the second end, and the gate. As shown in FIG. 6, the first end of the transistor T6 is electrically connected to the first end of the transistor T3, and is configured to receive the first voltage signal ($V_{REF}$), and the second end of the same is electrically connected to the anode of the light emitting diode 102. The gate of the transistor T6 is configured to receive the scan signal (S). In the duration D1, the pixel driving circuit 10C turns on the transistor T6 according to the scan signal (S) and resets the anode of the light emitting diode 102. In the duration D2, the transistor T6 is in the off state. Hence, in the duration D1, the anode of the light emitting diode 102 is pulled to the low level ($V_{REF}$), to ensure that the light emitting diode 102 does not emit light in the duration D1. In an embodiment, the reference signal $V_{REF}$ is less than a sum of OVSS and an turn-on voltage of the light emitting diode, and may be, for example, set to OVSS, but is not limited thereto.

Figure 7:
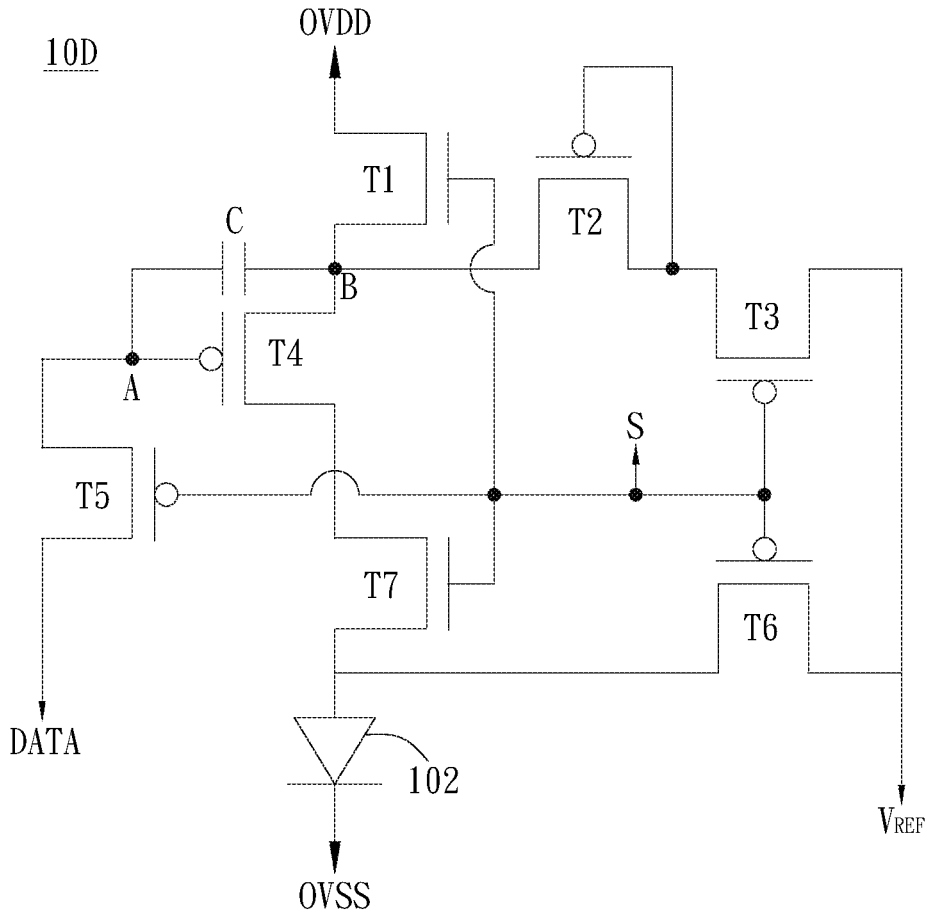
FIG. 7 and FIG. 8 are schematic diagrams of different embodiments of a pixel driving circuit having a single scan signal.
Figure 8:
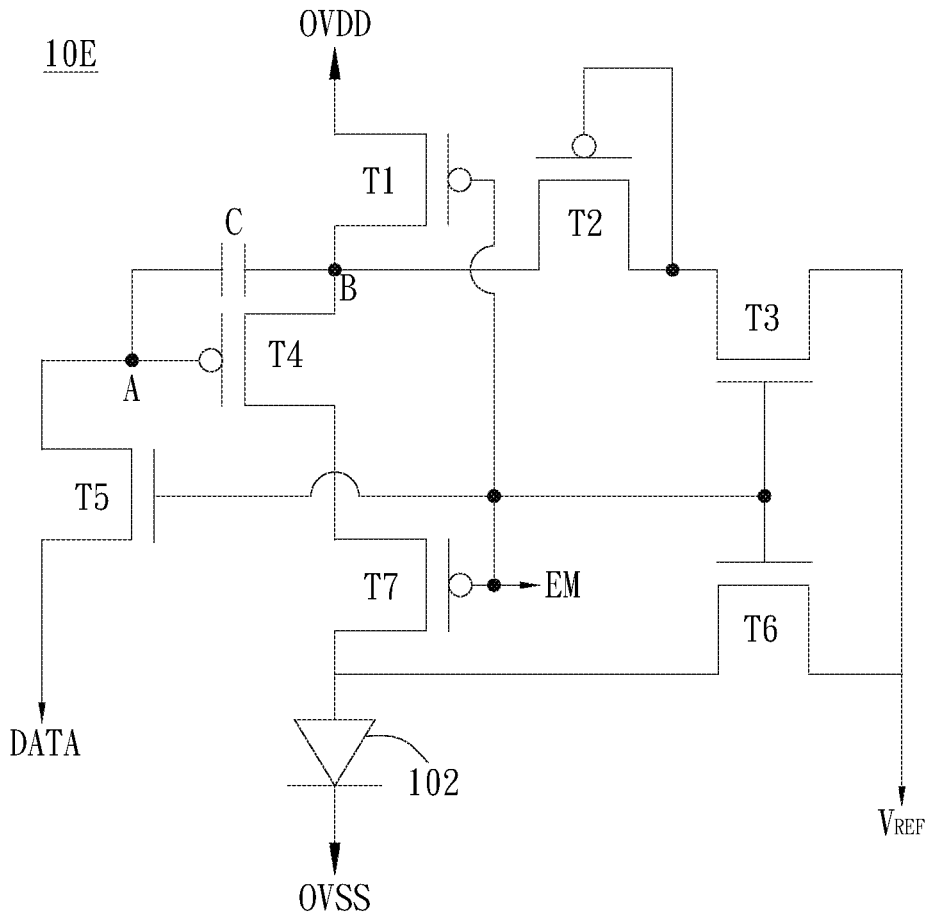

FIG. 7 and FIG. 8 are schematic diagrams of different embodiments of a pixel driving circuit 10D and a pixel driving circuit 10E that have a single scan signal. This embodiment differs from the embodiment in FIG. 6 in that the pixel driving circuit 10D shown in FIG. 7 and the pixel driving circuit 10E shown in FIG. 10 have a single scan signal. As shown in FIG. 7, the gates of the transistors T1, T3, T5, and T7 all receive the scan signal (S). In addition, the gate of the transistor T6 also receives the scan signal (S). Specifically, the transistor T1 and the transistor T7 are transistors of the same type (for example, N-type transistors). When the transistor T3 and the transistor T5 are transistors of the same type different from the type to which the transistor T1 (for example, a P-type transistor) belongs, the scan signals are integrated into the same scan signal source. By means of further simplifying the circuit design, the circuit layout area is reduced. In another embodiment, the scan signal received by the gates of the transistors T1 and T7 can be independent of the scan signal received by the gates of the transistors T3 and T5, but output waveforms of the two scan signals are substantially in phase.

As shown in FIG. 8, the gates of the transistors T1, T3, T5, and T7 all receive the scan signal EM. In addition, the gate of the transistor T6 also receives the scan signal EM. Specifically, the transistor T1 and the transistor T7 are P-type transistors, the transistor T3 and the transistor T5 are N-type transistors, and the scan signals are integrated into the same scan signal source. By means of further simplifying the circuit design, the circuit layout area is reduced. In another embodiment, the scan signal received by the gates of the transistors T1 and T7 can be independent of the scan signal received by the gates of the transistors T3 and T5, but output waveforms of the two scan signals are substantially in phase. By means of the foregoing circuit design, the circuit layout area is reduced, and no direct-current quiescent current path is generated during the operation process, so that power consumption can be reduced.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A pixel driving circuit, comprising:
a first transistor, comprising:
a first end;
a second end; and
a gate, wherein the first transistor receives a data signal via the first end or the gate;
a second transistor, comprising:
a first end electrically connected to the first end of the first transistor;
a second end; and
a gate connected to the second end of the second transistor;
a third transistor, comprising:
a first end configured to receive a first voltage signal;
a second end connected to the second end of the second transistor; and
a gate configured to receive a first scan signal and turn on the third transistor according to the first scan signal;
a fourth transistor, comprising:
a first end electrically connected to the gate of the first transistor;
a second end configured to receive a second voltage signal; and
a gate configured to receive the first scan signal and turn on the fourth transistor according to the first scan signal;
a fifth transistor, comprising:
a first end configured to receive a first supply voltage;
a second end electrically connected to the first end of the first transistor; and
a gate configured to receive a second scan signal;
a sixth transistor, comprising:
a first end electrically connected to the second end of the first transistor;
a second end; and
a gate configured to receive the second scan signal;
a light emitting diode, comprising:
an anode electrically connected to the second end of the sixth transistor; and
a cathode configured to receive a second supply voltage; and
a capacitor electrically connected between the first end and the gate of the first transistor.

2. The pixel driving circuit according to claim 1, further comprising a seventh transistor, comprising:
a first end;
a second end electrically connected to the anode of the light emitting diode; and
a gate configured to receive the first scan signal, turn on the seventh transistor according to the first scan signal, and reset the anode of the light emitting diode.

3. The pixel driving circuit according to claim 1, wherein the first voltage signal is the data signal, the second voltage signal is a reference signal, and a voltage level of the data signal is greater than a voltage level of the reference signal.

4. The pixel driving circuit according to claim 3, further comprising a seventh transistor, comprising:
a first end electrically connected to the second end of the fourth transistor and configured to receive the second voltage signal;
a second end electrically connected to the anode of the light emitting diode; and
a gate configured to receive the first scan signal or the second scan signal.

5. The pixel driving circuit according to claim 1, wherein the first voltage signal is a reference signal; the second voltage signal is the data signal, and a voltage level of the data signal is less than a voltage level of the reference signal.

6. The pixel driving circuit according to claim 5, further comprising a seventh transistor, comprising:
a first end electrically connected to the first end of the third transistor and configured to receive the first voltage signal;
a second end electrically connected to the anode of the light emitting diode; and
a gate configured to receive the first scan signal or the second scan signal.

7. The pixel driving circuit according to claim 1, wherein when the first transistor, the second transistor, the third transistor, the fourth transistor, the fifth transistor, and the sixth transistor are transistors of the same type, waveforms of the first scan signal and the second scan signal are substantially in anti-phase.

8. The pixel driving circuit according to claim 1, wherein when the fifth transistor and the sixth transistor are transistors of the same type, the third transistor and the fourth transistor are transistors of the same type different from the type to which the fifth transistor belongs, waveforms of the first scan signal and the second scan signal are substantially in phase.

9. The pixel driving circuit according to claim 1, wherein the first transistor and the second transistor are transistors of the same type.

10. The pixel driving circuit according to claim 1, wherein when the fifth transistor and the sixth transistor are in an off state, the third transistor and the fourth transistor are in an on state.

* * * * *